US006280112B1

(12) United States Patent
Vieu

(10) Patent No.: US 6,280,112 B1
(45) Date of Patent: Aug. 28, 2001

(54) APPLICATION MEMBER FOR THE APPLICATION OF A PRODUCT TO THE SKIN AND ASSEMBLY THUS EQUIPPED

(75) Inventor: Valerie Vieu, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/453,168

(22) Filed: Dec. 2, 1999

(30) Foreign Application Priority Data

Dec. 3, 1998 (FR) ..... 98 15291

(51) Int. Cl.[7] ..... A46B 11/00

(52) U.S. Cl. ..... 401/122; 401/130; 401/126; 401/6

(58) Field of Search ..... 401/122, 121, 401/130, 126, 261, 266, 6, 118, 119, 128, 123, 124, 125, 127

(56) References Cited

U.S. PATENT DOCUMENTS

| | | | | |
|---|---|---|---|---|
| 634,606 | * | 10/1899 | Beeching | 401/130 |
| 1,834,085 | * | 12/1931 | Bloom | 401/128 |
| 2,106,313 | * | 1/1938 | Amrine | 401/128 |
| 4,869,612 | * | 9/1989 | Mooney et al. | 401/130 |
| 5,860,432 | * | 1/1999 | Gueret | 401/122 |
| 5,937,873 | * | 8/1999 | Schlosser et al. | 401/130 |

FOREIGN PATENT DOCUMENTS

| | | | |
|---|---|---|---|
| 3207797A1 | | 11/1983 | (DE) . |
| 0 792 602 | | 9/1997 | (EP) . |
| 0 832580 | | 4/1998 | (EP) . |
| 2 330 353 | | 6/1977 | (FR) . |
| 2 094 235 | | 9/1982 | (GB) . |
| 2097662 | * | 11/1982 | (GB) ..... 401/122 |
| WO 91/01097 | | 2/1991 | (WO) . |

* cited by examiner

*Primary Examiner*—David J. Walczak
(74) *Attorney, Agent, or Firm*—Oblon, Spivak, McClelland, Maier & Neustadt, P.C.

(57) ABSTRACT

Application member for the application of a product to the skin, including a gripping element and an application element, integral with the gripping element, the application element being flexible, and having at least a first substantially planar face, the width of which in a direction perpendicular to an axis of the gripping element decreases in the direction of a free end located opposite the gripping element, the first face being delimited by two lateral edges, at least one of which is of concave form. Further included herein is an application assembly equipped with such an application member and a method to the use of this application member for the treatment of wrinkles.

24 Claims, 3 Drawing Sheets

APPLICATION MEMBER FOR THE APPLICATION OF A PRODUCT TO THE SKIN AND ASSEMBLY THUS EQUIPPED

BACKGROUND OF THE INVENTION

1. Field of the Invention

The invention relates to an application member for the application of a product, particularly a cosmetic or dermatological product, to a surface such as the skin, and to an application assembly containing the product and equipped with an application member of this type.

2. Discussion of the Background

The assembly envisaged by the present invention is of the type comprising a reservoir containing the product and provided with an open end over which a stopper acting as a gripping member is removably fastened. The stopper is integral with the application member, generally by means of a wand, so that the application member, in the closed position of the assembly, is permanently immersed in the product.

The reservoir is intended, in particular, to contain a dermatological product, a make-up product or a product for specific treatment of the body and more particularly of the face, such as a liquid foundation, a blusher or an eyeshadow. More specifically, the application member is designed for the application of a product for treating the signs of skin aging, such as wrinkles and small wrinkles and the signs of fatigue, particularly those of the face, neck or décolletage.

A number of products have been proposed in the past with the aim of erasing or blurring the signs of skin aging. More recently, in Patent Applications FR-A-2 758 083 and FR-A-2 759 084, the Applicant has described novel products intended for treating signs of aging and of fatigue, based on particularly effective "tightening agents". During aging, the skin has an increasingly irregular micro relief and exhibits wrinkles and small wrinkles.

In the case of tightening agents, these are compounds which are capable of tightening the skin and, through this tightening effect, smoothing the skin and immediately reducing or even erasing wrinkles and small wrinkles thereof. These products have a particular texture and have rapid drying properties.

The direct application of this type of product using the fingers is unsuitable. In fact, even with the lightest massaging, finger friction suffices to break up the product's texture.

Thus, the problem posed by the present invention consists in providing an application member capable of:

depositing just the necessary quantity of product;

having a geometry to suit the surface to be treated;

being flexible, supple and soft, given the sensitivity of the skin of the eye contour area and of the fragility of the product's texture;

spreading the product rapidly, particularly in a single stroke, before the product dries.

The areas of the face particularly targeted by the invention are wrinkles in the eye contour area, such as "crow's feet" at the outer corner of the eyes, dark rings and bags under the eyes, wrinkles at the corners of the mouth, etc.

FR-A-2 506 580 discloses a flat, supple applicator, in the form of a spatula, for applying a make-up product. This applicator, intended to be loaded with a very fluid product by capillary effect, cannot be used for the products envisaged by the present invention. Moreover, its shape is not particularly suited to the application of the said products to the areas of the body targeted by the invention.

SUMMARY OF THE INVENTION

Thus, a first object of the present invention is to provide an application member adapted to the treatment of the skin, particularly of the aforesaid areas of the face.

A second object of the invention consists in an application member capable of conferring as gentle an application as possible to the skin whilst still guaranteeing a high level of precision during application.

A further object of the invention consists in an application member capable of selectively treating a single wrinkle or a "bundle" of wrinkles.

A yet further object of the invention consists in an application assembly including a treatment-product reservoir and provided with an application member of this type.

The application assembly according to the invention is intended for carrying in the user's handbag or it may be used for renewing the treatment during the day, particularly whilst travelling.

Thus, the subject of the present invention is an application member, for the application of a product to the skin, including a gripping element and an application element, integral with the said gripping element, the said application element being flexible, and having at least a first substantially planar face, the width of which in a direction perpendicular to an axis of the gripping element decreases in the direction of a free end located opposite the said gripping element, the said first face being delimited by two lateral edges, at least one of which is of concave form. Thus, when the application member is loaded with product, the first face may be used as an application surface. The lateral edge of concave form is adapted particularly to the shape of the lower part of the eyes. To this end, the concave lateral edge advantageously has a radius of curvature of between 16 mm and approximately 30 mm.

In the sense of the present invention, the term "flexible" is used to denote the ability of the application element to curve, in response to a stress, and to resume its initial form by means of elasticity when the stress ceases. The ability of a material of this type to flex may be characterized by its flexural modulus in flexure. Generally, the materials envisaged by the invention have a flexural modulus of flexure which is at least equal to 200 MPa (Young's modulus in flexure). The flexibility may be the result of the nature of the material forming the application element and/or its configuration.

According to a particularly preferred embodiment, one of the lateral edges is of concave shape, the other of the lateral edges being of convex shape. In this case, the two lateral edges may have different radii of curvature. Advantageously, the radius of curvature of the convex lateral edge is greater than the radius of curvature of the concave lateral edge. Alternatively, the two lateral edges may be concave.

Thus, the user, holding the gripping element in the right hand, applies the planar face to the area to be treated, located, for example, below the right eye, the concave edge of the application element matching the edge of the lower eyelid.

In order to be able to carry out the same treatment on the lower part of the left eye, using the same hand or the left hand, the second face of the application element, opposite the first one, is also preferably substantially planar.

Preferably, at least the free end of the application element is of rounded form. In this case, the curvature of this free end has a radius of between approximately 1 mm and approximately 3 mm.

As regards the application element, it may be produced from natural or synthetic rubber, particularly from polyurethane or from thermoplastic elastomer. It may consist of a foam with closed or semi-open cells or include a flocked covering. Advantageously, the application element has a mean thickness of between approximately 1 mm and approximately 3 mm.

By virtue of the choice of these materials and of the thickness of the application element, the latter has a flexibility such that, as it brushes against the skin, a portion of the corresponding face of the application element is applied tangentially to the surface of the skin, without giving rise to notable deformation of the latter.

According to a preferred embodiment, the application element has a length of approximately 20 mm measured along the axis of the gripping element. Advantageously, this gripping element is connected to the application element by means of a wand of small diameter, which makes it easier to handle the application member.

Advantageously, the application element has a mean width of approximately 7 mm measured in a direction perpendicular to the axis of the gripping element. This width is adapted to cover the essential part of the wrinkles in the targeted wrinkled areas.

In practice, the application member is associated with a reservoir intended to contain a product, for example an anti-wrinkle treatment product, thus forming an application assembly. This reservoir includes an open end defining an opening over which a closure element is removably fastened. Advantageously, this closure element consists of a generally cylindrical stopper, which forms the gripping element integral with the application element described above.

In order to be able to guarantee correct metering of the product and its homogeneous distribution on the application element, a drying member is advantageously provided, located in the vicinity of the open end of the reservoir. This drying member is capable of metering the quantity of product taken up by the application member. Preferably, this drying member consists of an elastomeric material and has at least one slit extending over a substantial part of the section of the drying member. In the storage position of the assembly, the wand carrying the application element passes through the slit.

According to one embodiment, the drying member may comprise a plurality of slits intersecting in the vicinity of the center of the drying member. According to an advantageous aspect of the invention, each end of the slit or slits may be extended by at least one portion oriented in a different direction from the axis of the corresponding slit. In particular, each end ends in a "V" portion centred on the axis of the corresponding slit and the apex of which is adjacent to the corresponding slit. The free ends of the "V" portion may be oriented away from the corresponding slit or, alternatively, towards the corresponding slit. The angle of opening of the "V" slit may be between 30° and 180° and preferably between 30° and 90°.

Alternatively, each end of a slit ends in an opening, the form of which is advantageously circular. Typically, the diameter of this opening is of the order of 1 mm.

The application member which has just been described can be used, in particular, for the application of a product capable of treating wrinkles and small wrinkles, particularly of the eye contour area and of the corners of the mouth, based on a product containing tightening agents of the type mentioned above.

BRIEF DESCRIPTION OF THE DRAWINGS

Further objects of the invention will become apparent in a detailed manner upon reading the following description of an embodiment of the invention which is given by way of purely illustrative and non-limiting example, shown in the appended drawing.

In this drawing.

DETAILED DESCRIPTION OF THE PREFERRED EMBODIMENTS

Figure 1:
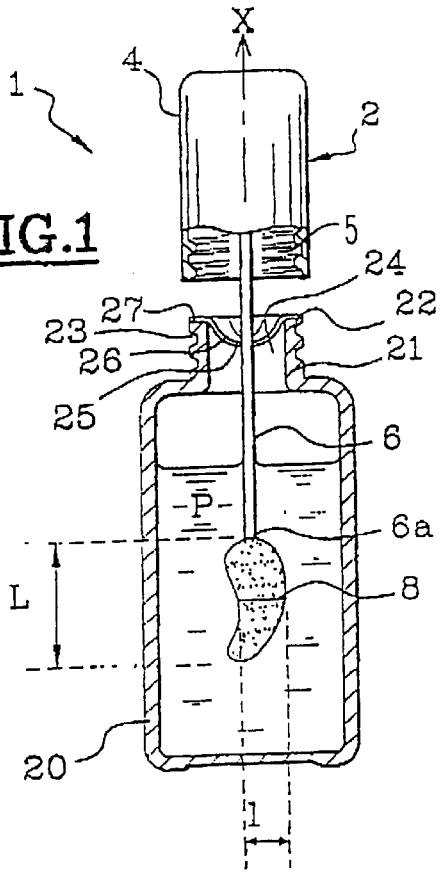
FIG. 1 shows a view in axial section of an application assembly according to the invention.
Figure 2:
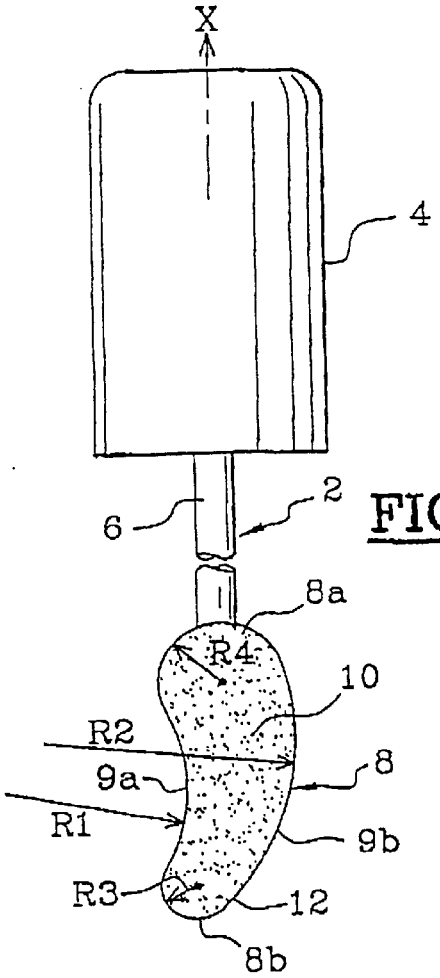
FIG. 2 is an enlarged view of the application member of the assembly of FIG. 1.

With reference to FIGS. 1 and 2, an application assembly 1 can be seen, of axis X, for the application of a product P and equipped with an application member 2. The application member 2 includes a stopper 4 serving as a gripping element and a closure element, and capable of being fastened, by screwing, onto the neck 21 of a bottle 20 of cylindrical form. The bottle 20 forms a reservoir containing the product P of liquid to pasty or gel consistency. The neck 22 includes an outer screw thread 23 capable of interacting with a complementary screw thread 5 on the lower portion inside the stopper 4, thereby allowing the stopper 4 to act as a closure element. The stopper 4 acts as a gripping element since the stopper has a general elongate cylindrical form, allowing easy gripping. The stopper 4 is provided with a central wand 6 emerging from the lower side of the stopper 4. This wand 6 has a lower end 6*a* to which an application element 8 is fastened, for example by adhesive bonding, interlocking or heat welding.

The application element has two ends, a first end 8*a* adjacent to the wand 6 and a second free end 8*b*. The two ends have a rounded form, the radius of curvature $R_4$ of the first end 8*a* being greater than the radius of curvature $R_3$ of the second free end 8*b*. According to the example in question, $R_4$ is approximately 4 mm $R_3$ being approximately 1 mm. The distance between the two ends 8*a* and 8*b*, measured along the axis X, is approximately 20 mm.

The two ends 8*a*, 8*b* are separated from each other by two edges 9*a*, 9*b*. The edge 9*a* is concave and has a radius of curvature $R_1$. The edge 9*b* is convex and has a radius of curvature $R_2$. In the embodiment illustrated, $R_1$ is greater than $R_2$. This makes it possible to obtain good convergence of the lateral edges 9*a*, 9*b* in the direction of the free end 8*b*.

$R_1$ is adapted to the curvature of the lower eyelid. Typically, $R_1$ is of the order of 20 mm. $R_2$ is of the order of 16 mm. The mean distance l separating the two lateral edges 9*a* and 9*b*, measured in a direction perpendicular to the axis X of the wand, is of the order of 7 mm. In its widest portion, the application element 8 has a width of approximately 8 mm.

The application element has two principal faces 10 which are substantially planar and parallel to each other. The distance between these two surfaces defines the thickness of the application element, this thickness being chosen as a function of the flexibility of the material used for producing the application element 8. Generally, this thickness is between approximately 1 mm and approximately 3 mm.

Figure 7:
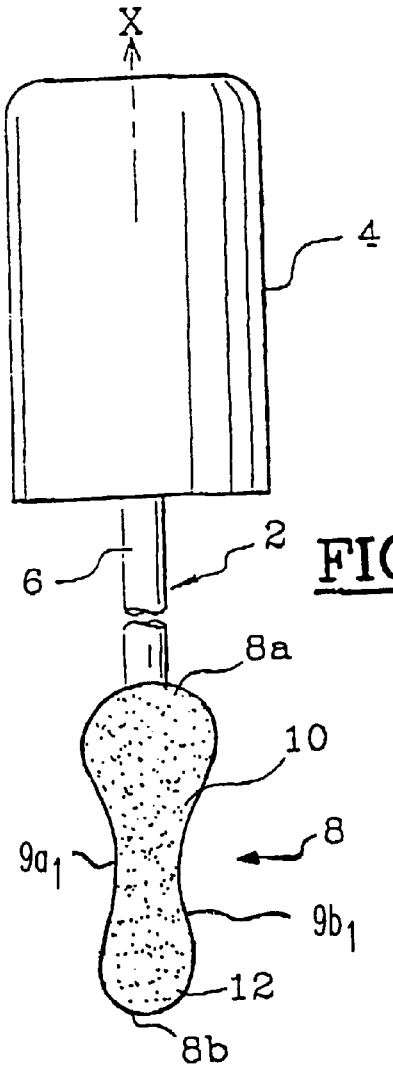
FIG. 7 illustrates an enlarged view of a second embodiment of the application member of the assembly of the present invention.

FIG. 7 depicts a second embodiment of the application element 8 where the later edge $9a_1$, and the lateral edge $9b_1$, are both concave.

The material forming the application element 8 is a material which is elastically deformable, particularly in flexure. It may be chosen from natural or synthetic rubbers and preferably from thermoplastic elastomers. Advantageously, a closed-cell or semi-open-cell elastomer foam is chosen. Optionally, the surface of the application element 8 may be flocked, which makes it possible to increase its capacity to retain product P and thus to increase its autonomy.

The neck 21 of the bottle has a free circular edge 22 defining an opening 24. A drying member 26 (FIG. 1) formed from an elastically deformable material is fitted in this opening. The drying member has the form of a thin membrane and has a circular peripheral edge 27 resting on the free edge 22 of the neck of the bottle. The central portion 25 of the drying member is shaped as a dish, the bottom of which faces the reservoir 20. The drying member has one or more slits 28 (FIGS. 3*a*, 3*b*), 28*a*–28*d* (FIGS. 4*a*, 4*b*). When several slits are present, these intersect at a central point C. In a storage position, the wand 6 passes through this slit or these slits.

Figure 3A:
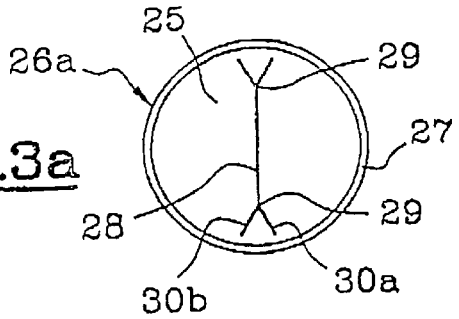
FIG. 3*a* shows an enlarged top view of a drying member according to a first embodiment.
Figure 3B:
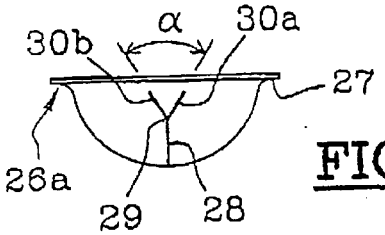
FIG. 3*b* shows a view in axial section of the drying member of FIG. 3*a:*
Figure 4A:
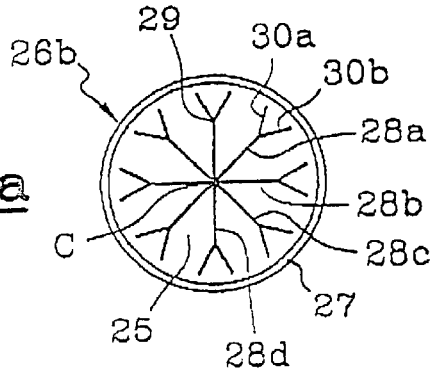
FIG. 4*a* shows an enlarged top view of a drying member according to a second embodiment.
Figure 4B:
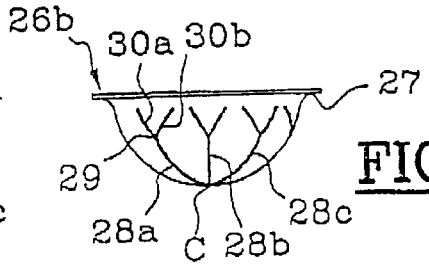
FIG. 4*b* shows a view in axial section of the drying member of FIG. 4*a:*

As may be seen in FIGS. 3*a* and 3*b*, a single rectilinear slit 28 is made, the terminal portions 29 of which are extended by means of two branches 30*a*, 30*b* arranged as a "V" and together defining an angle $\alpha$ of approximately 60°.

FIGS. 4*a* and 4*b* show a further embodiment of a drying member 26*b*, according to which the bottom 25 is provided with four slits 28*a*–28*d* intersecting at the center C of the membrane. In a similar manner to the embodiment of the slit of FIG. 3*a*, the slits 28*a*–28*d* shown in FIGS. 4*a* and 4*b* have a terminal part 29 extended by two branches 30*a*, 30*b* in the form of a "V".

The structure of the slits with their "V" terminal part allows supple opening of the edges of the slit 28, 28*a*–28*d* during removal of the application element 8 from the bottle 20 or during its insertion into it. Moreover, the edges of the slit or slits ensure correct spreading of the product P on the application element during removal of the application member, removing any excess of product P and ensuring homogeneous distribution over the application surface 10.

Figure 5:
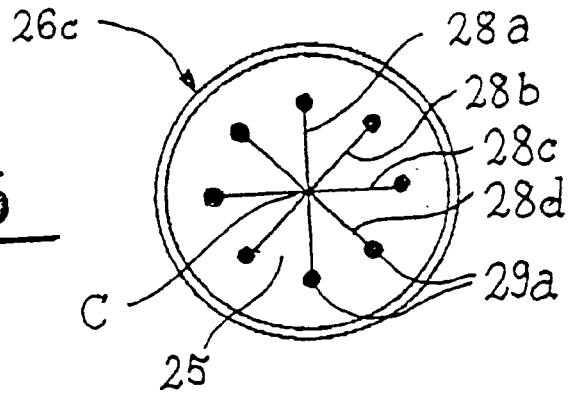
FIG. 5 shows an enlarged top view of a drying member according to a third embodiment.

FIG. 5 shows a third embodiment of a drying member 26*c*, according to which the bottom 25 is provided with four slits 28*a*–28*d* intersecting at the center C of the membrane in a similar manner to the embodiment of the slits of FIG. 4*a*. Each slit 28*a*–28*d* shown in FIG. 5 has two terminal parts formed by an opening 29*a*. Typically, each opening 29*a* is circular and has a diameter of approximately 1 mm.

Figure 6:
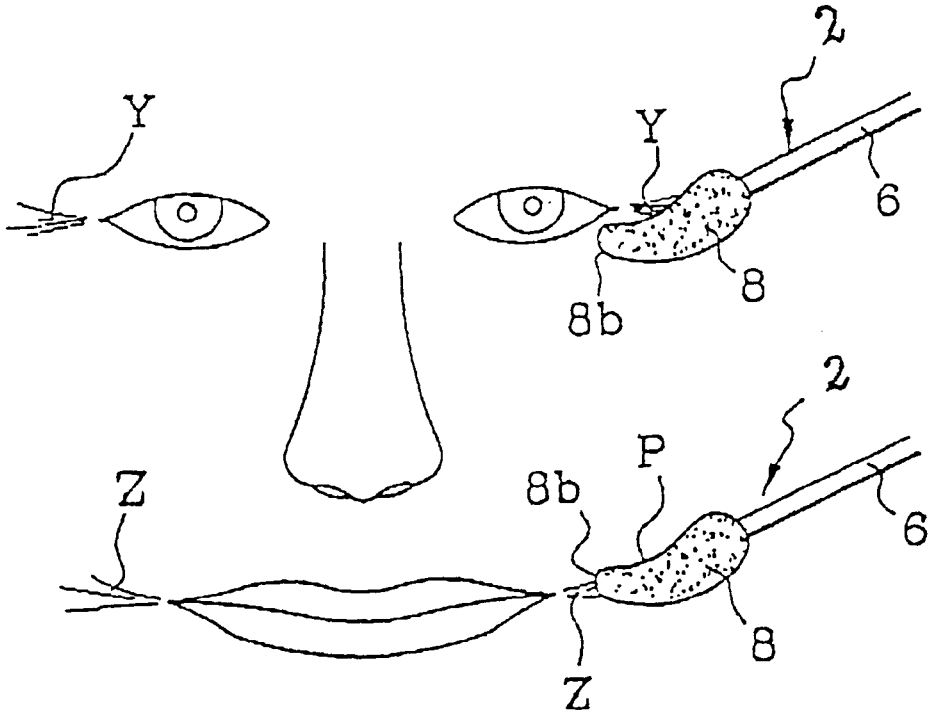
FIG. 6 illustrates the application of an anti-wrinkle product to the face, using the application member according to the invention.

FIG. 6 illustrates the application of an anti-wrinkle product using the application member 2 according to the invention to the wrinkled areas of the contour area of the eyes Y and of the corners of the mouth Z. By lightly applying just the free end 8*b* of the application element, it is possible to spread the product P over a single wrinkle, ensuring homogeneous and precise smoothing of the product over the wrinkle in question without deposition of excess product at the edge of the wrinkle. The product is applied gently, without detrimental effect on the product's texture. In this application mode, the user holds the application member so that an angle of approximately 30° to 60° is formed between the wand 6 and the surface of the skin.

In order to treat a more extensive wrinkled area, for example the wrinkled area below the eye, the application element 8 is applied with a greater bearing force than in the previous case. This gives rise to flexing of the application element so that a larger and particularly wider surface area of the application element comes into contact with the skin. In this case, the surface 10 of the application element comes into contact with the skin tangentially. By following the area to be treated with the application element, product is spread just in the depths of the wrinkles where, through the action of the tightening agent present in the product, blurring and even erasing of the wrinkles is produced after drying.

The form of the application element is particularly adapted to the treatment of rings under the eyes. The product may be spread in a single operation. Thus, a first face of the application element is used to apply the product to the rings under the right eye, using the right hand, whilst the other face is applied to the rings under the left eye, using the left hand.

Figure 8:
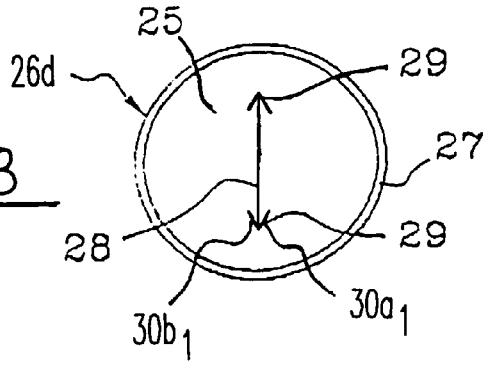
FIG. 8 shows as enlarged top view of a drying member according to a fourth embodiment.

FIG. 8 depicts a fourth embodiment of a drying member 26*d* having at least one slit 28 with terminal portions 29 of which are extended by means of two branches $30a_1$, $30b_1$ arranged as a "V". The branches $30a_1$, $30b_1$ are oriented such that the free ends thereof are oriented in a direction towards the slit 28.

In the above detailed description, reference has been made to particular embodiments of the invention. Obviously, variations may be made to it without departing from the spirit of the invention as claimed hereinbelow.

What is claimed as new and desired to be secured by Letters Patent of the United States is:

1. An application member for the application of a product to the skin, comprising a gripping element and an application element, attached to said gripping element, said application element being flexible, and having at least a first substantially planar face, a portion of said first face having a width in a direction perpendicular to an axis of the gripping element that decreases in a direction of a free end located opposite said gripping element, said portion being delimited by two lateral edges, one of which is of concave form, and the other of which is of convex form.

2. The application member according to claim 1, characterized in that the application element comprises a second face opposite the first face, said second face being substantially planar.

3. The application member according to claim 1, characterized in that the two lateral edges have different radii of curvature.

4. The application member according to claim 1, characterized in that said concave lateral edge has a radius of curvature of between 16 mm and approximately 30 mm.

5. The application member according to claim 1, characterized in that at least the free end is of rounded form.

6. The application member according to claim 1, characterized in that the free end of the application element has a curvature having a radius of between approximately 1 mm and approximately 3 mm.

7. The application member according to claim 1, characterized in that the application element is made from natural or synthetic rubber, foam, polyurethane, or thermoplastic elastomer.

8. The application member according to claim 1, characterized in that the application element has a length of approximately 20 mm measured along the axis of the gripping element.

9. The application member according to claim 1, characterized in that the application element has a mean length of approximately 7 mm measured in a direction perpendicular to the axis of the gripping element.

10. The application member according to claim 1, characterized in that the application element has a mean thickness of between approximately 1 mm and approximately 3 mm.

11. An application assembly including a reservoir intended to contain a product and a free edge of which delimits an opening over which a closure element is removably fastened, said closure element being attached to an application element, wherein the application element comprises a gripping element and an application element, attached to said gripping element, said application element being flexible, and having at least a first substantially planar face, with a width in a direction perpendicular to an axis of the gripping element that decreases in a direction of a free end located opposite said gripping element, said first face being delimited by two lateral edges, at least one of which is of concave form.

12. The application assembly according to claim 11, characterized in that a drying member is arranged in the vicinity of the opening and is capable of metering a quantity of product taken up by said application element.

13. The application assembly according to claim 12, characterized in that the drying member consists of an elastomeric material and has at least one slit extending over a substantial part of a section of the drying member.

14. The application assembly according to claim 13, characterized in that the drying member comprises a plurality of slits intersecting in the vicinity of a center of the drying member.

15. The application assembly according to claim 14, characterized in that each slit of the plurality of slits extends along a corresponding axis, each end of each slit having at least one portion extending in a different direction from the corresponding axis of a corresponding slit.

16. The application assembly according to claim 15, characterized in that each end ends in a V-portion centered on the corresponding axis of the corresponding slit and an apex of which is adjacent to the corresponding slit.

17. The application assembly according to claim 16, characterized in that the V-portion has free ends that are oriented away from the corresponding slit.

18. The application assembly according to claim 16, characterized in that the V-portion has free ends that are oriented in the direction of the corresponding slit.

19. The application assembly according to claim 16, characterized in that the V-portion has an angle of opening that is between 30° and 180° and preferably between 30° and 90°.

20. The application assembly according to claim 14, characterized in that each slit extends along an axis, each end of the slit including an opening.

21. The application assembly according to claim 20, characterized in that the opening has a diameter of approximately 1 mm.

22. A method of use of an application member comprising a gripping element and an application element, attached to said gripping element, said application element being flexible, and having at least a first substantially planar face, a portion of said first face having a width in a direction perpendicular to an axis of the gripping element that decreases in a direction of a free end located opposite said gripping element, said portion being delimited by two lateral edges, one of which is of concave form, and the other of which is of convex form, said method comprising the step of applying a product suitable for treating wrinkles with the application member.

23. An application assembly including a reservoir intended to contain a product and a free edge of which delimits an opening over which a closure element is removably fastened, said closure element being attached to an application element, wherein the application element comprises a gripping element and an application element, attached to said gripping element, said application element being flexible, and having at least a first substantially planar face, with a width in a direction perpendicular to an axis of the gripping element that decreases in a direction of a free end located opposite said gripping element, said first face being delimited by two lateral edges, both of which are of concave form.

24. A method of use of an application member comprising a gripping element and an application element, attached to said gripping element, said application element being flexible, and having at least a first substantially planar face, a portion of said first face having a width in a direction perpendicular to an axis of the gripping element that decreases in a direction of a free end located opposite said gripping element, said portion being delimited by two lateral edges, both of which are of concave form, said method comprising the step of applying a product suitable for treating wrinkles with the application member.

* * * * *